US007585008B2

(12) United States Patent
Jenkins

(10) Patent No.: US 7,585,008 B2
(45) **Date of Patent: *Sep. 8, 2009**

(54) BAG GRIPPER FOR PLASTIC BAG HANDLES

(75) Inventor: James H. Jenkins, Winston Salem, NC (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/840,776

(22) Filed: Aug. 17, 2007

(65) Prior Publication Data

US 2008/0018125 A1 Jan. 24, 2008

Related U.S. Application Data

(63) Continuation of application No. 10/407,985, filed on Apr. 4, 2003, now Pat. No. 7,328,925.

(51) Int. Cl.
*B65D 33/06* (2006.01)

(52) U.S. Cl. ..... 294/159; 294/137

(58) Field of Classification Search ..... 294/159, 294/137, 141, 142, 158, 163, 168, 169, 160, 294/162, 167, 170, 103.1; D9/434, 455; 248/316.1, 340; D3/328; 16/114.1, 428; 383/6, 13, 15, 25, 26, 29

See application file for complete search history.

(56) References Cited

U.S. PATENT DOCUMENTS 2,398,948 A 4/1946 Martinez
2,521,473 A 9/1950 Merisuo
2,539,496 A 1/1951 Towey
2,592,389 A 4/1952 Budy
3,755,859 A 9/1973 Solari
4,023,762 A 5/1977 Batts et al.
4,112,541 A 9/1978 Tetradis
4,623,185 A 11/1986 Thomas
D325,169 S 4/1992 Montoya
5,181,757 A 1/1993 Montoya
5,263,755 A 11/1993 Thompson
D358,094 S 5/1995 DeGiacomo, Jr.
5,599,052 A 2/1997 Van Davelaar
5,904,388 A 5/1999 Seibel
5,921,601 A 7/1999 Buckles
5,944,178 A 8/1999 Mao
5,957,513 A 9/1999 Merritt
6,434,803 B1 8/2002 Spong (Continued)

OTHER PUBLICATIONS

U.S. Appl. No. 11/840,784, filed Jul. 18, 2007, Jenkins.

*Primary Examiner*—Paul T Chin
(74) *Attorney, Agent, or Firm*—Tillman Wright, PLLC; Chad D. Tillman; James D. Wright

(57) ABSTRACT

A bag grip includes a movable jaw for securing handles of plastic or other bags therein. A battery powered light is contained within the body of the grip for use at night or other times when artificial light is required. The grip is molded from a conventional durable plastic and will allow the user to easily, manually transport multiple shopping or other bags having handles. A shoulder strap is attached to the body for additional convenience while carrying heavy loads.

10 Claims, 6 Drawing Sheets

U.S. PATENT DOCUMENTS

| | | | |
|---|---|---|---|
| D465,719 | S | 11/2002 | Ditzig et al. |
| 6,711,784 | B2 | 3/2004 | Walker |
| 6,923,356 | B2 | 8/2005 | Reynolds |
| 2002/0105798 | A1 | 8/2002 | Hill |
| 2007/0278807 | A1 | 12/2007 | Jenkins |
| 2007/0278808 | A1 | 12/2007 | Jenkins |

BAG GRIPPER FOR PLASTIC BAG HANDLES

CROSS-REFERENCE TO RELATED APPLICATION

The present application is a U.S. continuation patent application of, and claims priority under 35 U.S.C. §120 to, U.S. nonprovisional patent application Ser. No. 10/407,985, filed Apr. 4, 2003, now U.S. Pat. No. 7,328,925, which nonprovisional patent application and patent is hereby incorporated by reference herein.

FIELD OF THE INVENTION

The invention herein pertains to a device for use while manually carrying filled shopping bags and particularly pertains to a convenient hand grip for carrying multiple shopping bags simultaneously.

DESCRIPTION OF THE PRIOR ART AND OBJECTIVES OF THE INVENTION

Grocery stores and other retail outlets in recent years have increasingly provided lightweight plastic shopping bags for consumer's purchases. Due to the small size of such bags, for example groceries are often placed in three or more bags for each shopper. Standard plastic grocery bags have a pair of extending handles for use. To aid in the manual transportation of loaded shopping bags, various forms of grips, carriers and the like have been devised over the years. Examples of such prior devices are shown in the following U.S. Pat. Nos. Des. 325,169, Des. 358,094, 5,181,757 and 5,599,052.

While all bag carriers have some advantages, it has been found that many of the prior devices are limited to carrying only a very few shopping bags, such as three or four. Certain of the prior devices are susceptible to inadvertent release of the shopping bags and the consequent spilling thereof such as when the carrier is sharply tilted during use. Prior devices also do not employ illumination for the user in dark or night time conditions. Also, when prior devices engage heavily loaded bags, the user cannot readily ease the heavy burden, short of placing the carrier on the ground or other rest location.

Thus, with the problems and disadvantages of prior art bag grips and carriers, the present invention was conceived and one of its objectives is to supply a grip for shopping bag handles which will allow the bag handles to be easily and securely held.

It is another objective of the present invention to provide a bag grip which has accommodations from six to eight shopping bags.

It is still another objective of the present invention to provide a bag grip which has a pivotable jaw to secure the bag handles therein.

It is yet another objective of the present invention to provide a bag grip which includes a battery powered light to assist the user at night.

It is also an objective of the present invention to provide a bag grip having a shoulder strap to lessen the user's burden while carrying heavy bags.

It is still a further objective of the present invention to provide a bag grip which can be molded from a conventional plastics by standard techniques.

It is a further objective of the present invention to provide a bag grip which is easy to operate and relatively inexpensive to manufacture and purchase.

Various other objectives and advantages of the present invention will become apparent to those skilled in the art as a more detailed description is set forth below.

SUMMARY OF THE INVENTION

The aforesaid and other objectives are realized by providing a preferred bag grip having a c-shaped molded body with a handle along the top and a mouth at the bottom joined by a central stanchion. The bottom includes a stationary lower jaw with a series of lateral peaks and valleys which are opposingly positioned to lateral peaks and valleys on the upper jaw when closed. The upper jaw in the preferred form moves or pivots in a vertical direction for raising and lowering, to load and unload shopping bag handles which are received in the valleys.

The grip body is sized for easily holding by one hand and includes a non-slip resilient covering for retention purposes.

A shoulder strap is attached to the top which allows the user to momentarily release the hand from the grip such as while opening a car door, and prevents having to place the bags on the ground.

In the lower part of the stationary jaw a battery operated light is provided with a convenient switch proximate the body handle to allow the user to turn the light on and off as needed.

In use, the movable jaw is first lifted to an open position. Bag handles are then placed within the valleys and the movable jaw thereafter is closed against the stationary lower jaw. The bag grip containing the bags can then be carried to a car or other destination. If the bags are heavily loaded, the shoulder strap can be placed over the user's shoulders to relieve the load from the hand. To remove the bags, the jaw is opened, the loaded bags removed from the grip and placed into, for example a vehicle. Should the grip be used during night or dark conditions, a switch is turned on to allow the light to assist the user in walking, and can further be used to focus on a car door or trunk lock as needed.

The grip can be placed in the vehicle while the bag handles remain therein if desired. Once the consumer arrives at his home or other destination, the grip can be again lifted and carried with the loaded bags to the final destination, such as to a kitchen. There, the moveable jaw of the grip is opened, the bags removed and the grip can be stored for future use.

DETAILED DESCRIPTION OF PREFERRED EMBODIMENTS AND OPERATION

Figure 1:
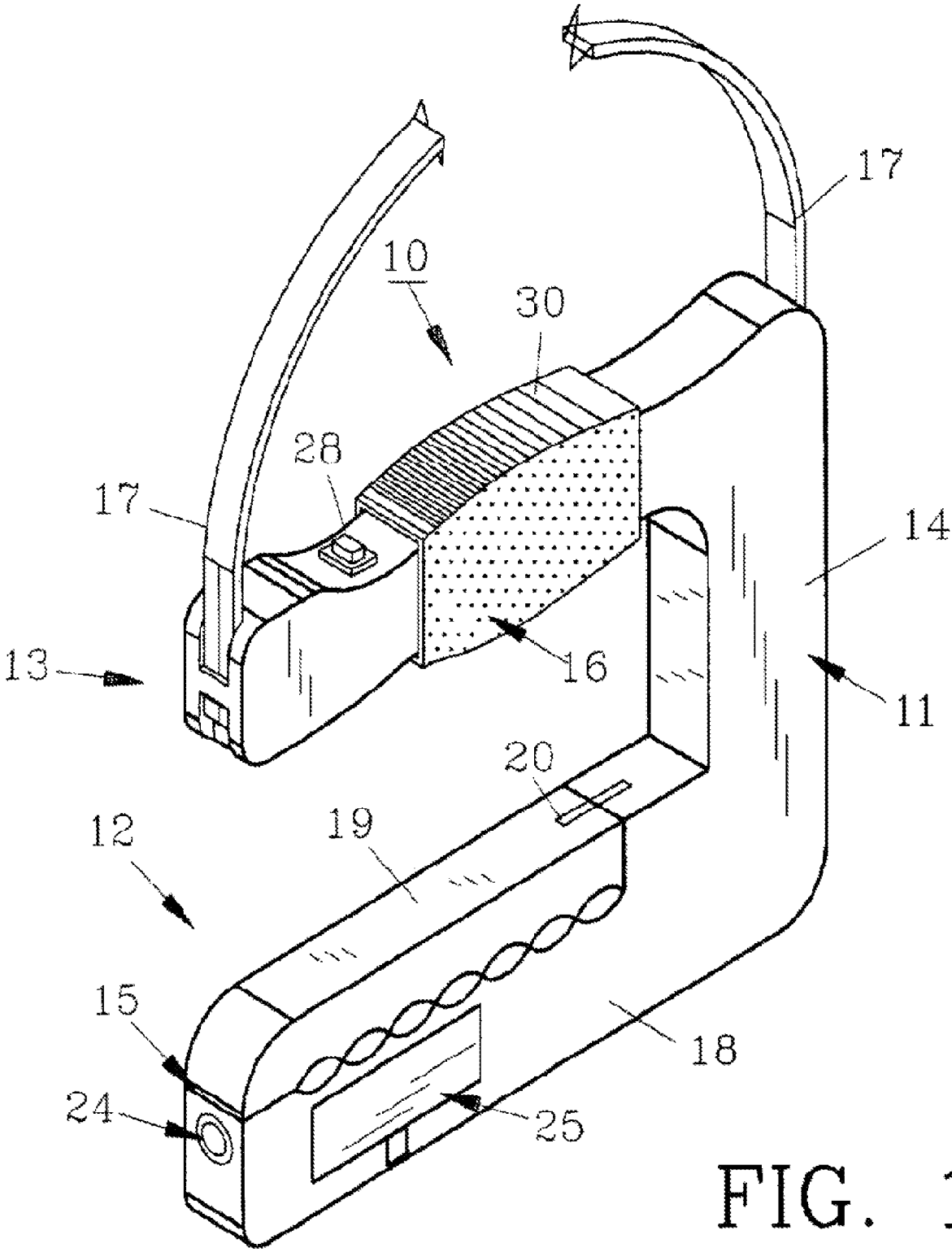
FIG. 1 shows a perspective view of the preferred embodiment of the invention with the shoulder strap fragmented and the upper jaw in a closed posture.
Figure 2:
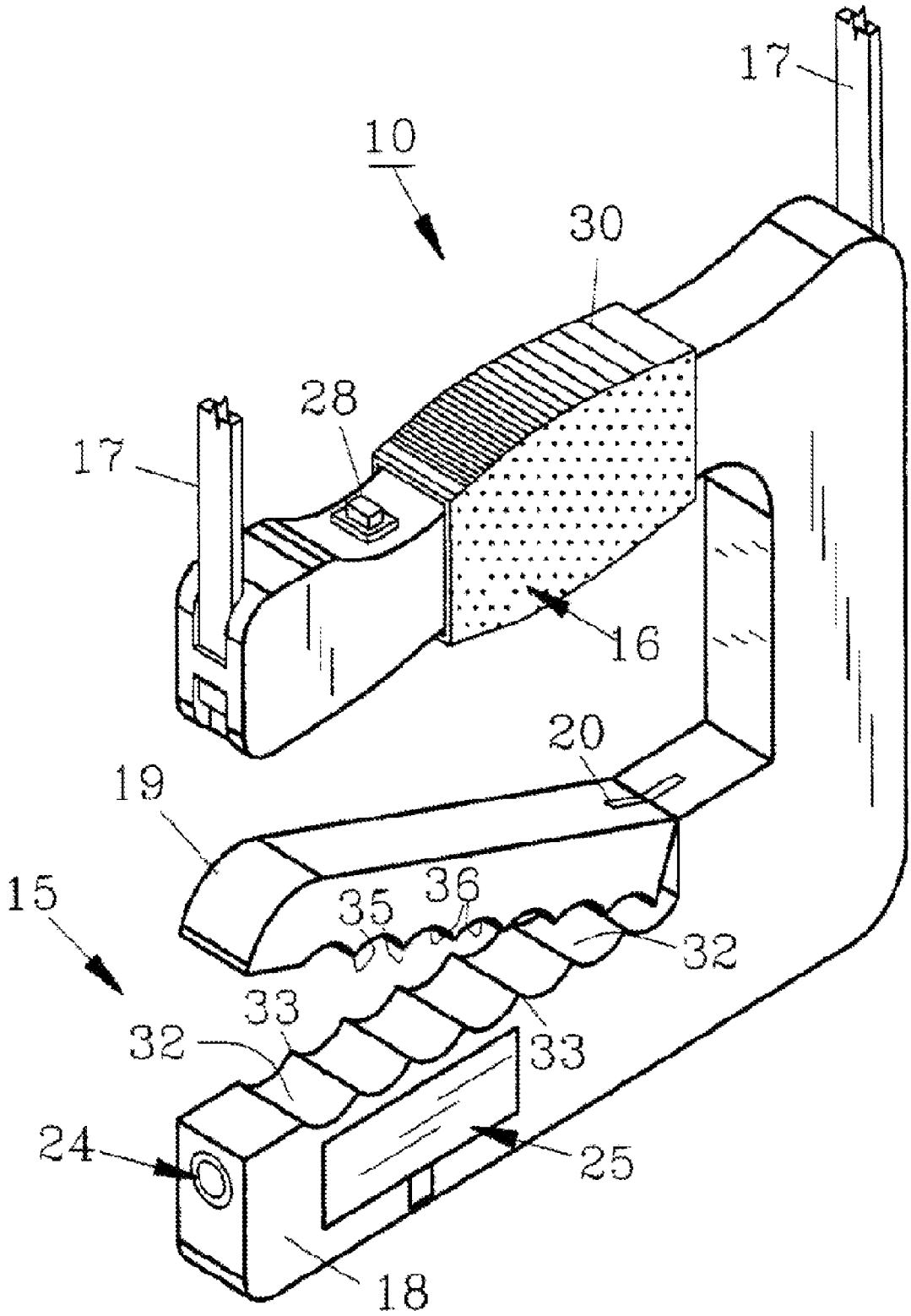
FIG. 2 features a side view of the invention of FIG. 1 with the upper jaw raised for loading purposes.
Figure 6:
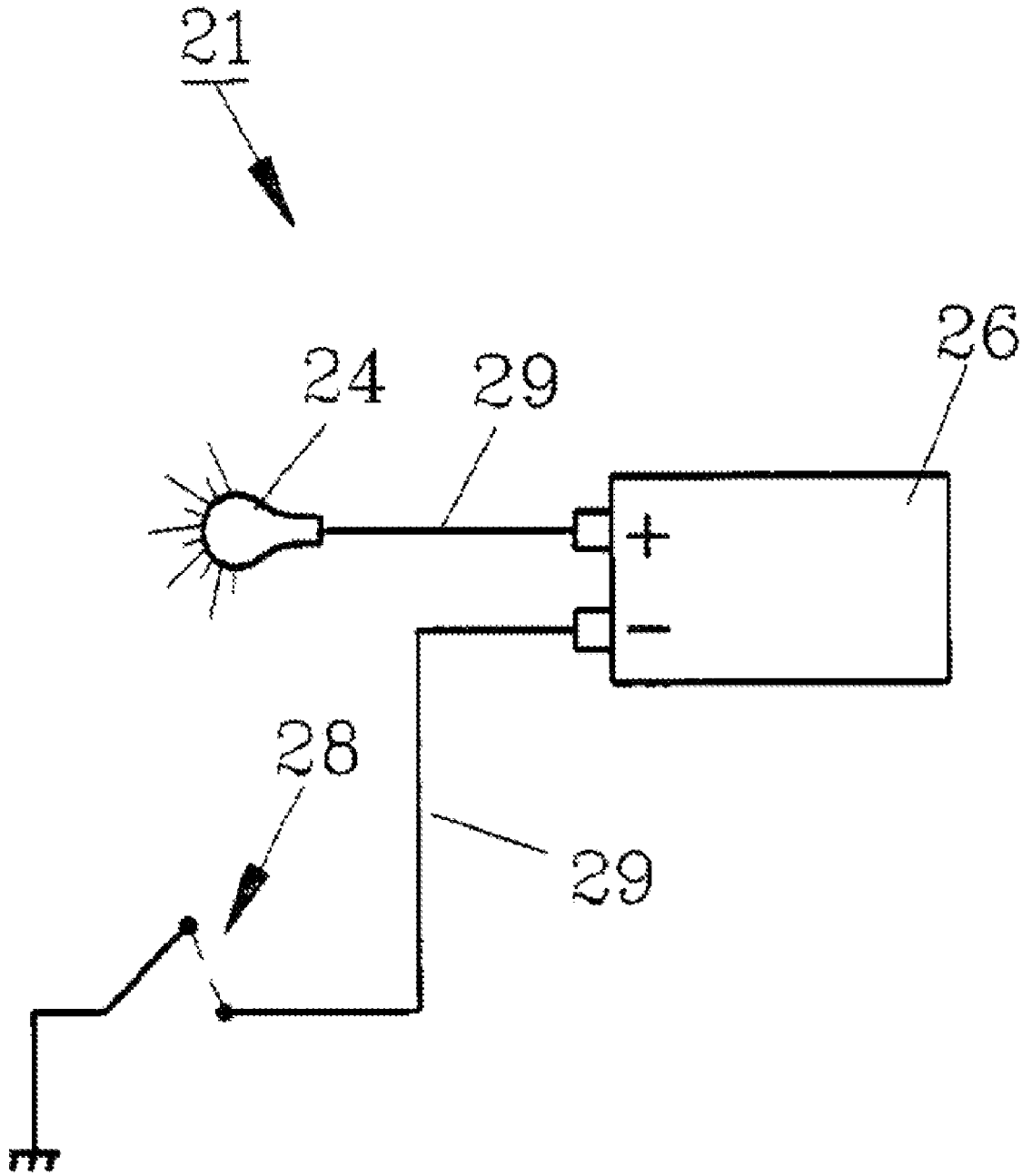
FIG. 6 illustrates a schematic view of the electrical circuitry.

For a better understanding of the invention and its operation, turning now to the drawings, FIG. 1 shows preferred bag grip 10 having a C-shaped body 11 preferably formed from a conventional polymeric material such as by molding. Body 11 includes a bottom 12, top 13 and central stanchion 14, all joined as by integrally molding the same. Top 13 includes body handle 16 as shown in FIGS. 1 and 2. Bottom 12 includes mouth 15 formed by stationary jaw 18 and pivotable jaw 19 affixed thereto, seen raised in FIG. 2 and affixed to hidden hinge 20. Stationary jaw 18 includes battery powered light 24 as shown schematically in circuit 21 seen in FIG. 6. Battery 26 is contained within battery compartment 25 as shown in FIGS. 1 and 2. Switch 28 is connected to lamp 24 by conductors 29 within body 14, shown schematically in FIG. 6. Body handle 16 is covered with a resilient non-slip sleeve 30 which may be formed from foam rubber, plastic, or other suitable materials. Top 13 is also provided with preferred nylon shoulder strap 17, which may be adjustable for assistance while carrying heavily filled bags.

In use, upper jaw 19 is lifted as shown in FIG. 2 and bag handles 80, (FIG. 4) as on for example grocery bags, are placed within valleys 32 of lower jaw 18, as seen in FIG. 2. As further shown, pointed peaks 33 are between valleys 32. As also shown, upper jaw 19 includes pointed peaks 35 and valleys 36 which are opposingly positioned to pointed peaks 33 and valleys 32 of stationary jaw 18 when upper jaw 19 is closed as shown in FIG. 1. As further shown in FIGS. 1, 3 and 4, upper (movable) peaks 35 or 71 (identified in FIGS. 2 and 5) are in contact with lower (stationary) peaks 33 or 68 (identified in FIGS. 2 and 5) when upper jaw 19 is closed. Upper valleys 36 and lower valleys 32 define lateral channels for securing bag handles 80 therein during carrying.

Figure 3:
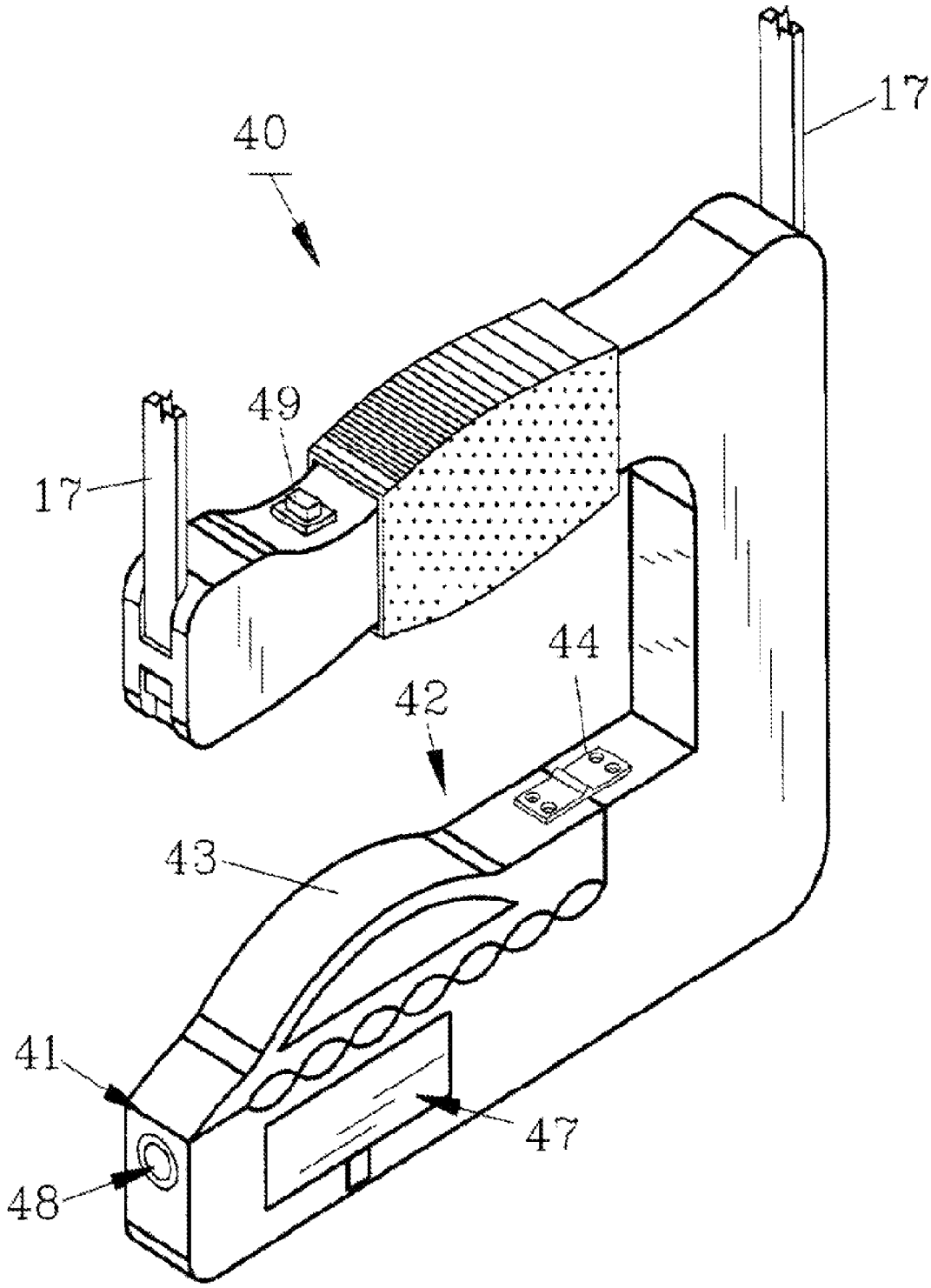
FIG. 3 demonstrates a perspective view of the first alternate embodiment of the invention.

In a first alternate embodiment of the invention as shown in FIG. 3, bag grip 40 includes upper jaw 42 having rail 43 to allow for convenience in opening jaw 42 of mouth 41. Hinge 44 is exposed (whereas hinge 20 is hidden as shown in FIGS. 1 and 2) and allows pivotable jaw 42 to readily, vertically open for accepting bag handles therein. Battery compartment 47 can also be opened for battery replacement for light 48. Switch 49 is similar to switch 28 as shown in FIG. 1 and turns light 48 on and off as needed.

Figure 4:
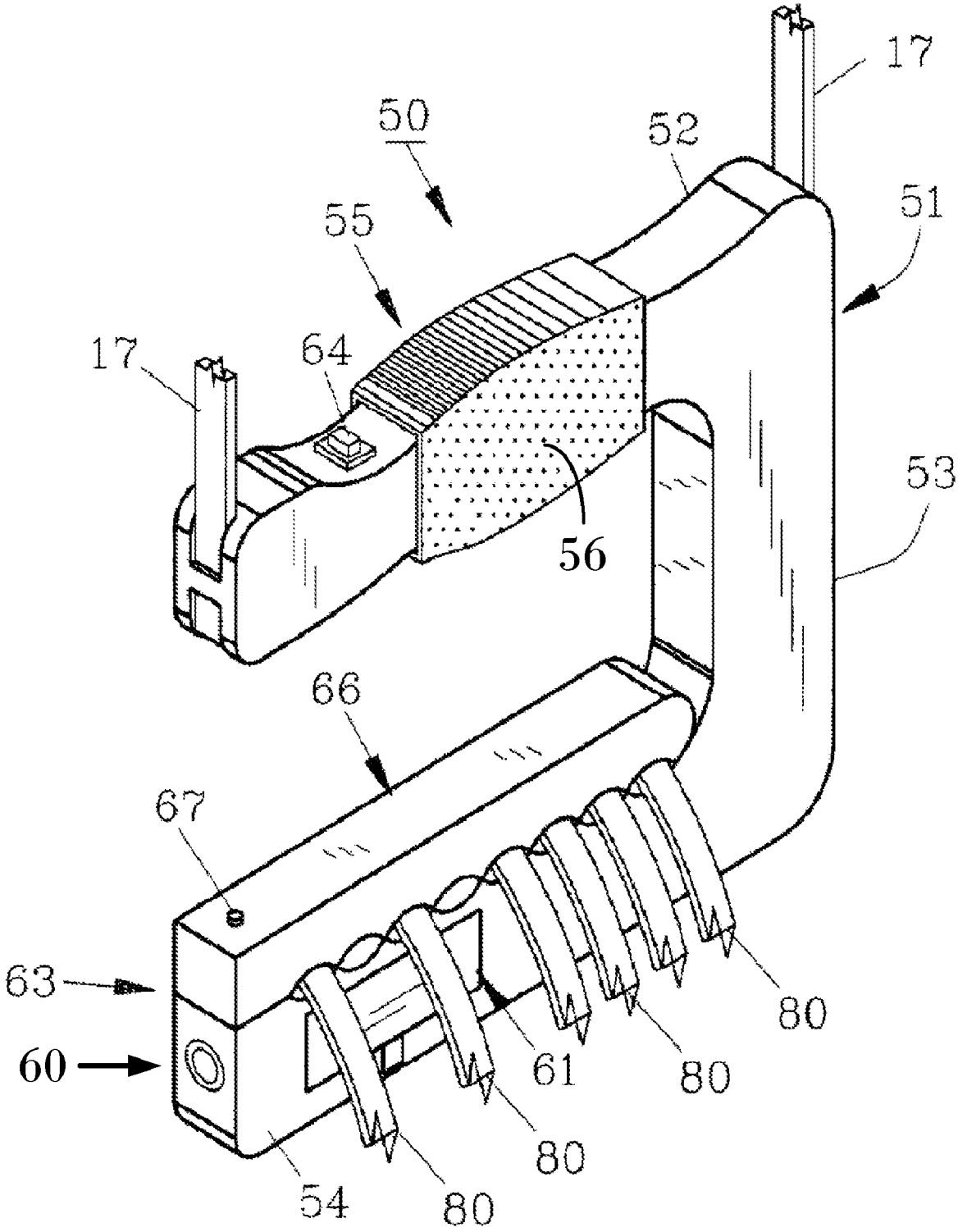
FIG. 4 shows a perspective view of a second alternate embodiment of the invention.

In FIG. 4, a second alternate embodiment of the invention is shown with bag grip 50 having shoulder strap 17 as shown in FIG. 1. Bag grip 50 includes body 51 having top 52, stanchion 53 and bottom 54. Top 52 includes a resilient non-slip cover 55 over handle 56 similar to cover 16 as shown in FIG. 1.

Figure 5:
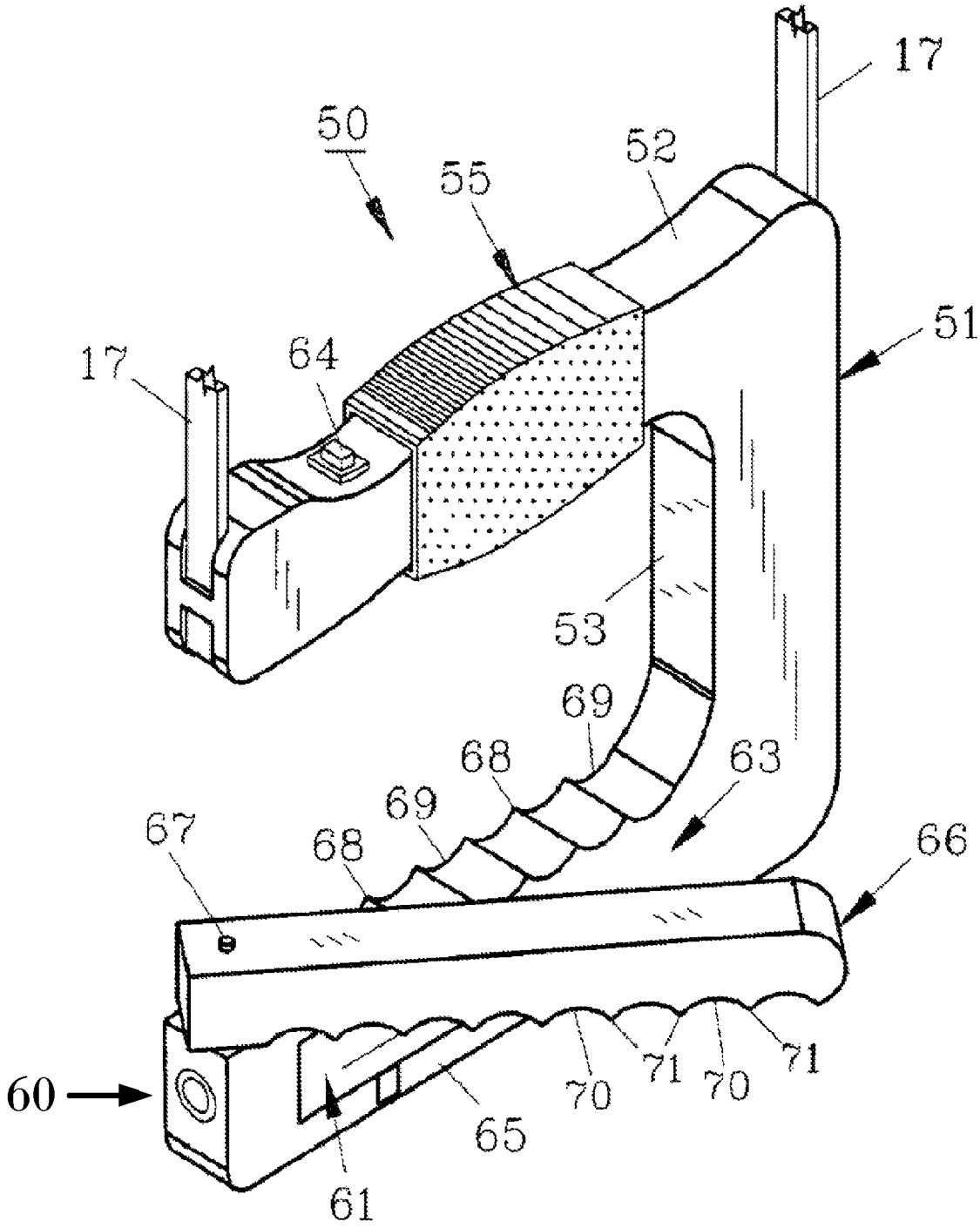
FIG. 5 demonstrates a perspective view of the invention as shown in FIG. 4 with the upper jaw pivoted as in loading or unloading.

Light 60 is powered by batteries contained within battery compartment 61 and is operated by switch 64 shown mounted on top 52 in FIG. 4. Lower jaw 65 of mouth 63 is stationary whereas upper jaw 66 is horizontally pivotable about pivot pin 67. As shown in FIG. 5, upper jaw 66 can be opened by horizontal rotation to allow placement of plastic bag handles 80 therein. Bag handles 80 are placed in valleys 69 of lower jaw 65 opposite valleys 70 of upper jaw 66. Pointed peaks 71 of upper jaw 66 and pointed peaks 68 of lower jaw 65 are opposingly positioned and in contact with each other as shown in FIG. 4 when upper jaw 66 of mouth 63 is closed. While upper jaw 66 and lower jaw 65 provide lateral grooves for eight (8) bags, more or less peaks and valleys could be positioned therealong as required.

In the method of use, a bag grip such as bag grip 10 shown in FIGS. 1 and 2 is opened by pivoting upper jaw 19 vertically as shown in FIG. 2. A series of bag handles 80 of conventional plastic grocery bags are then placed within valleys 32. Upper jaw 19 is then closed and bag grip 10 can be lifted by holding handle 30. Should the load contained within the bag grip be especially heavy, shoulder strap 17 can be placed over the user's shoulder to ease the load. Light 24 can be turned on as required by manipulation of switch 28 during night or other times of insufficient light.

The illustrations and examples provided herein are for explanatory purposes and are not intended to limit the scope of the appended claims.

What is claimed is:

1. A bag grip for carrying of a plurality of bags having handles, comprising:

(a) a body comprising a top member, a bottom member, and an intermediate member extending between and joining the top member and the bottom member, wherein the top and bottom member generally extend in spaced, parallel relation to one another away from the intermediate member, the bottom member defining peaks and valleys; and (b) a movable member mounted to the body for movement relative to the bottom member, the movable member having peaks and valleys that correspond to the bottom member such that the peaks of the movable member contact the peaks of the bottom member when the movable member is disposed relative to the bottom member, thereby defining separate enclosures between adjacent contacting peaks for separately securing handles of bags positioned on the bottom member for carrying with the bag grip.

2. The bag grip of claim 1, wherein the body includes opposite ends, and further comprising a shoulder strap, the shoulder strap attached to the body at a location proximate one of the ends of the body, and wherein the body is configured to receive a handle of a bag proximate the other the end of the body.

3. The bag grip of claim 1, further comprising a light incorporated into the body of the bag grip.

4. The bag grip of claim 3, wherein the light is located proximate an end of the bottom member.

5. The bag grip of claim 4, wherein a switch that is operatively connected to the light for actuating the light is located proximate an opposite end of the body relative to the light.

6. The bag grip of claim 1, wherein the body is generally C-shaped in profile.

7. A bag grip for carrying of a plurality of bags having handles, comprising (a) a body comprising a top member, a bottom member, and an intermediate member extending between and joining the top member and the bottom member, wherein the top and bottom member generally extend in spaced, parallel relation to one another away from the intermediate member, the bottom member defining peaks and valleys;

(b) a movable member mounted to the body for movement relative to the bottom member, the movable member having peaks and valleys that correspond to the bottom member such that the peaks of the movable member contact the peaks of the bottom member when the movable member is disposed relative to the bottom member, thereby defining separate enclosures between adjacent contacting peaks for separately securing handles of bags positioned on the bottom member for carrying with the bag grip;

(c) a shoulder strap attached to the body at a location proximate an end of the body; and (d) a light incorporated into the body of the bag grip.

8. The bag grip of claim 7, wherein the light is located proximate an end of the bottom member.

9. The bag grip of claim 8, wherein a switch that is operatively connected to the light for actuating the light is located proximate an opposite end of the body relative to the light.

10. The bag grip of claim 7, wherein the body is generally C-shaped in profile.

* * * * *